United States Patent [19]

Helinski et al.

[11] Patent Number: 5,031,526

[45] Date of Patent: Jul. 16, 1991

[54] LUBRICATION SYSTEM FOR A PRINT HAMMER MECHANISM AND ASSEMBLY

[75] Inventors: Edward F. Helinski, Johnson City; Thomas J. Kotasek, Endicott, both of N.Y.

[73] Assignee: International Business Machines Corp., Armonk, N.Y.

[21] Appl. No.: 486,022

[22] Filed: Feb. 26, 1990

[51] Int. Cl.[5] ..... B41J 9/00

[52] U.S. Cl. ..... 101/93.48; 400/157.1

[58] Field of Search ..... 101/93.28, 93.29, 93.30, 101/93.31, 93.32, 93.33, 93.34, 93.48; 400/441, 445.3, 157.2, 719, 157.1; 184/64

[56] References Cited

U.S. PATENT DOCUMENTS

| | | | |
|---|---|---|---|
| 4,557,192 | 12/1985 | Dollenmayer | 101/93.48 |
| 4,756,246 | 7/1988 | Kotasek et al. | 101/93.48 |
| 4,896,596 | 1/1990 | Helinski | 101/93.48 |

OTHER PUBLICATIONS

IBM Technical Disclosure, "Lubrication Delivery Method for Print Hammers," vol. 31, No. 10, Mar. 1989.

IBM Technical Disclosure, "Lubrication Method for Print Hammers," vol. 31, No. 10, Mar. 1989.

*Primary Examiner*—Edgar S. Burr
*Assistant Examiner*—C. A. Bennett
*Attorney, Agent, or Firm*—John S. Gasper

[57] ABSTRACT

A passive lubrication system for use in a high speed print hammer mechanism to provide continuous lubrication to all print hammers over the lifetime of the mechanism. A plurality of hammer elements are pivotally engaged by a common pivot pin element. The lubrication system comprises a hammer block and a reservoir block both made of sintered material and each containing a supply of lubricant. The hammer block supplies lubrication to the pivot pin/hammer element bearing interfaces by capillary action. The reservoir block in turn supplies lubricant to the hammer block by capillary action to replenish the supply of lubricant as depleted in the hammer block. The reservoir block has a porous microstructure in which the porosity is at least equal to but preferably in coarser than the porosity of the porous microstructure of the hammer block. In a high speed printer having plural hammer mechanisms, the lubrication system comprises a single reservoir block adapted for supplying lubricant simultaneously by capillary action to plural hammer blocks each containing a supply of lubricant and supplying lubricant to plural pivot pin elements by capillary action. In a printer having a hammer unit comprising multiple hammer mechanisms arranged in a single row, the lubrication system comprises multiple reservoir blocks each supplying lubricant simultaneously by capillary action to plural hammer blocks each of which supplies lubricant by capillary action to a pivot pin element which pivotally engages a plurality of spaced hammer elements all of which are arranged in a row.

21 Claims, 3 Drawing Sheets

LUBRICATION SYSTEM FOR A PRINT HAMMER MECHANISM AND ASSEMBLY

FIELD OF THE INVENTION

This invention relates to printing machines and particularly to a lubrication system for print hammers in an impact line printer.

BACKGROUND OF THE INVENTION

Impact line printers comprise a print hammer bank in which a plurality of hammer elements are arranged in a row along a print line. It is common for the hammer bank to have 132 print hammer elements spaced ten to the inch. For ease of assembly and repair, the hammer bank comprises plural hammer modules or subassemblies mounted on a frame which may be a single bar. For each hammer element, there is an electromagnetic actuator also mounted on the frame. The electromagnetic actuators are operatively connected to the hammer elements by slender push rods which are part of a connector subassembly comprising plural push rods supported by guide plates the connector subassemblies being mounted onto the hammer support frame. Each hammer subassembly comprises a plurality of hammer elements individually mounted on a common pivot pin held stationary by a hammer block. The hammer block commonly takes the form of a solid piece formed with integral fins or spacers which isolate the individual hammer elements from each other. The pivot pin passes through aligned holes in the spacers and holes in the hammer elements. This type of hammer unit construction may be seen in U.S. Pat. No. 3,241,480 as well as in several IBM Printers such as the 3203, 3211 and 4248 Printers. The hammer elements are operated in small angle oscillations on the pivot pin which oscillations cause rapid wear at the hammer element/pivot pin bearing interfaces unless lubricated.

Various lubrication systems have been designed to maintain the hammer/pivot pin bearing interfaces properly lubricated for longer periods of use. One passive lubrication system uses a porous sintered hammer block and spacers impregnated with a supply of lubricant. Lubricant is supplied by capillary flow of the lubricant from the spacers to the surface of the pivot pin in the vicinity of the hammer element/pivot pin interfaces. Such a lubrication system is described in U.S. Pat. No. 4,896,596. Such a lubrication system can also be seen in the IBM 4245 Printer. While the impregnated block contains a goodly supply of lubricant, it is not nearly enough for a long period of printer operation especially at high printer speeds. Therefore means have been provided for supplementing the lubricant in the sintered hammer blocks. In one lubrication system, the supplementary lubrication means takes the form of felt pads initially saturated with lubricant and placed in cavities within the sintered insert block. Lubricant is supplied to the sintered hammer block insert by capillary flow from the felt pads in the cavities. Such a system is described in U.S. Pat. No. 4,756,246. It has been found however, supplementary lubrication means formed of felt materials release the lubricant too rapidly, have inadequate capacity, need occasional and even frequent replacement or need periodic application of lubricant which is then transferred by capillary action to the sintered hammer support block.

In a dynamic lubrication system the supplementary lubrication means is a felt wick, one for each hammer block. The wicks are initially impregnated with lubricant and a portion placed in contact with an external surface of the hammer block. Another portion of the wicks overlays a perforated tube connected to a pump. The wicks are periodically wetted with metered amounts of lubricant supplied by the pump. Lubricant is distributed to the individual wicks of the plural hammer blocks by means of a tube having spaced perforations in contact the wicks. Such a dynamic system is used in the IBM 4248 Printer. While such a system assures lubrication over a longer period of printer life than the passive system using felt pads, the system is imprecise as to amount and distribution of lubricant and requires a larger number of parts and controls which add to printer cost. Additionally, the application of lubrication at specific sites determined by the location of the perforations in the tube tends to localize the lubrication such that some bearing interfaces may receive more or less lubrication than needed. There is also some difficulty in precisely determining the frequency or amount of lubricant to be applied due to the fact that variations in lubricating requirements of the individual hammers is not readily predictable.

SUMMARY OF THE INVENTION

Basically the invention provides a passive lubrication system which overcomes the problems of prior systems. Specifically, the invention provides a reservoir block made of sintered material containing a supplementary supply of lubricant which is supplied to one or more sintered hammer blocks of a printer hammer unit. The reservoir block and the hammer blocks have adjoining surfaces which form one or more transfer interfaces for the flow of lubricant from the reservoir block to the one or more hammer blocks. The reservoir and hammer blocks are made of a blend of bronze alloy. The reservoir block is made with a microstructure in which its porosity and the porosity of its adjoining interface surface is as coarse or coarser than the porosity of the hammer block and its adjoining interface surface. This assures that capillary flow will occur readily across the interface from the reservoir block to the hammer block. Where a single reservoir block supplies lubricant to plural hammer blocks which in turn lubricate plural pivot pin elements by capillary action, the lubricant flow occurs simultaneously to the plural hammer blocks by capillary action. In this way, each hammer block is supplied lubrication solely by capillary action and at the rate and in the amount as determined by depletion of lubricant from the hammer blocks. The use of a means such as pumps for periodically supplying metered quantities of lubricant is avoided and guesswork as to the amount to be supplied and how often is eliminated.

The preceding and other objects, feature and advantages of the present invention will become more readily apparent from the following detailed description of the presently preferred forms of the invention as illustrated in the accompanying drawings.

DETAILED DESCRIPTION OF THE INVENTION

Figure 1:
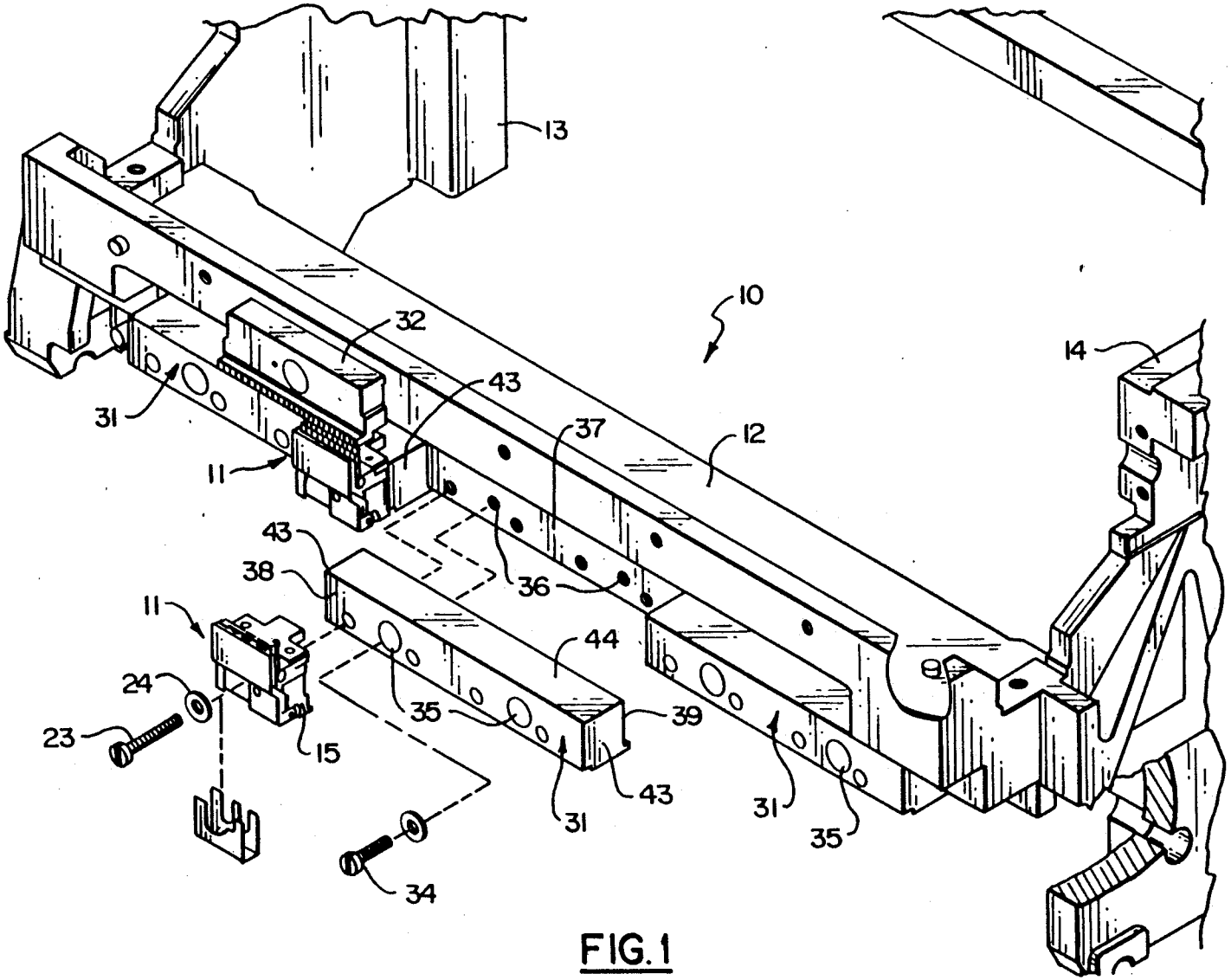
FIG. 1 is a three dimensional view of a portion of a print hammer unit for a line impact printer.
Figure 2:
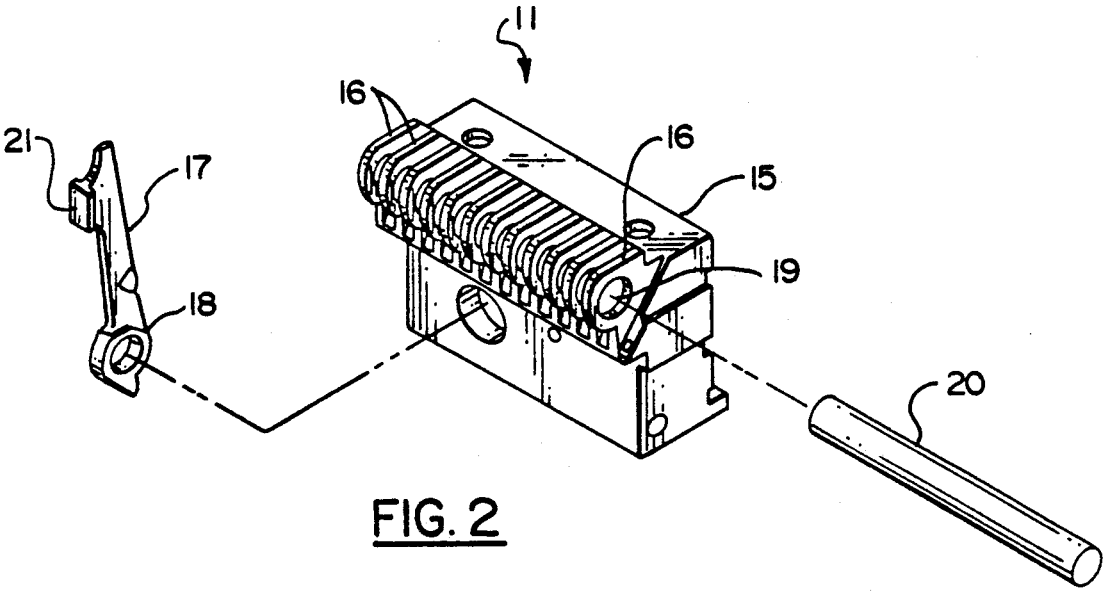
FIG. 2 is three dimensional exploded view of one of the hammer subassemblies of the printer hammer unit of FIG. 1.

As shown in FIGS. 1 and 2, a printer hammer unit comprises a frame 10 on which plural hammer subassemblies 11 are mounted. Frame 10 can be fabricated from a single piece of cast metal and includes a horizontal support bar 12 between vertical end walls 13 and 14. As best seen in FIG. 2, a hammer subassembly 11 is characterized by a hammer block 15 having a plurality of spacers 16, also called fins, arranged in a spaced apart relationship to receive a print hammer element 17 between two adjacent spacers 16. Other print hammer elements, like the print hammer element 17 are located between each of the other adjacent ones of the spacers 16. The stem part of the hammer element 17 has a hole 18 matching holes 19 in each spacer 17. A pivot pin 20 fits through holes 18 and 19 and forms bearing interfaces with the inner surfaces of hole 18 in the hammer elements 17. The stem hole 18 is slightly larger than the diameter of pivot pin 20 so that the hammer element 17 is freely pivotable when actuated to effect impact in the well known manner of the hammer face 21 with type on a moving carrier (not shown). Pivot pin 20 is fixed against rotation in any well known manner to one or more of the spacers 16.

Figure 4:
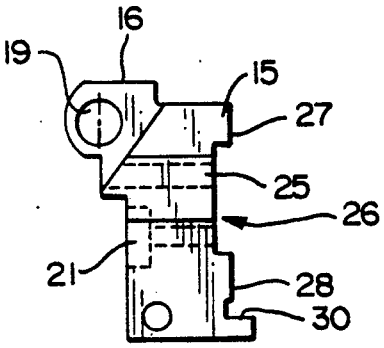
FIG. 4 is a side elevation of a hammer block used in one of the hammer subassemblies of FIG. 1.
Figure 3:
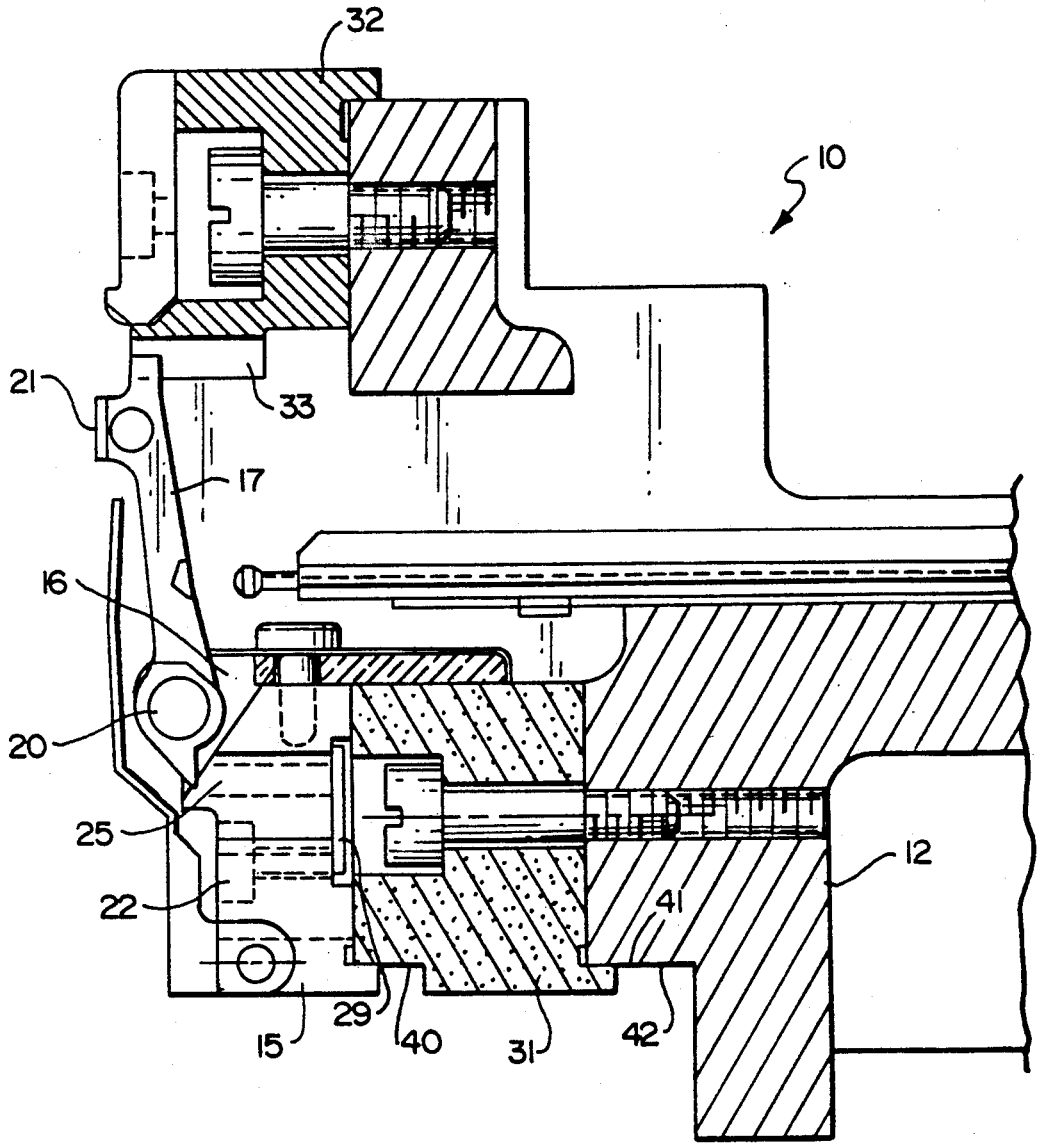
FIG. 3 is a side elevation in partial section of the hammer unit of FIG. 1.

As previously mentioned, hammer block 15 and spacers 16 are integral and formed of sintered material which is impregnated with a supply of lubricant. Thus each of the hammer subassemblies 11 has its own initial supply of lubrication. Lubrication is provided by capillary flow of the lubricant in the hammer block 15 through the spacers 16 to the bearing interfaces between hammer elements 17 and the surface of pivot pin 20. As best seen in FIGS. 3 and 4, hammer block 15 has countersunk hole 22 which receives attachment screw 23 and washer 24 (see FIG. 1). Hammer block 15 also has through hole 25 which receives a plunger and spring (not shown) which bias the hammer elements 17 clockwise to a rest position. A groove 26 between vertical locating surfaces 27 and 28 of hammer block 15 receives a retention plate 29 (see FIG. 3) which holds the spring and plunger in hole 24. Groove 26 is deep enough and retention plate 29 is thin enough, that the outside surface of the retention plate 29 is below the vertical locating surfaces 27 and 28 which preferably are coplanar. Hammer block 15 also has a horizontal locating surface 30. In addition to its function of receiving retention plate 29, groove 26 serves the important function of forming an interior vent for enhancement of capillary flow of lubricant in hammer block 15.

The hammer unit in the practice of this invention further comprises reservoir blocks 31 mounted between support bar 12 and hammer subassemblies 11. Guide blocks 32 with guide grooves 33, which act as receptacles for the free end of hammer elements 17, are attached to support bar 12 above reservoir blocks 31 and behind hammer subassemblies 11. As previously mentioned, reservoir blocks 31, which combine with hammer blocks 15 to form the lubrication system of this invention, are formed of sintered material, such as a blend of bronze alloy. Reservoir blocks 31 are impregnated with a supplemental supply of lubricant which is used to replenish the lubricant as depleted from the hammer blocks 15.

Attachment of reservoir blocks 31 is made by screws 34 which pass through countersunk holes 35 and into threaded holes 36 formed in the front surface 37 of support bar 12. In addition to serving as the opening for screws 34, the countersunk holes 35 serve the additionally important function of acting as interior vent means which enhances the capillary flow of lubricant through the sintered reservoir blocks 31.

Figure 5:
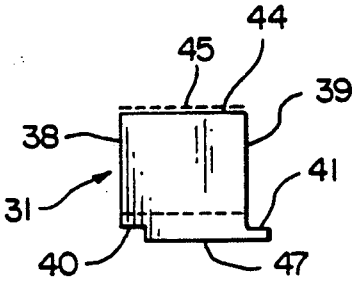
FIG. 5 is a side elevation of a reservoir block used in the hammer unit subassembly of FIG. 3.

As seen in FIG. 1, reservoir blocks 31 are elongate rectangular blocks arranged end-to-end on the front surface 37 of bar 12. Reservoir blocks 31 are formed with front and rear vertical locating surfaces 38 and 39 respectively fabricated to be both flat and parallel. When assembled, vertical locating surfaces 27 and 28 of hammer blocks 15 and vertical locating surface 38 of reservoir blocks 31 are adjoining and, because the locating surfaces 27, 28 and 38 are microporous, they form the interface for the capillary flow of lubricant from the reservoir blocks 31 to the hammer blocks 15. Reservoir blocks 31 also have a forward horizontal locating surface 40 which is engaged by horizontal locating surface 30 of hammer block 15 and a rear horizontal locating surface which engages the undersurface 42 of support bar 12 as best seen in FIGS. 3 and 5. When assembled on support bar 12, the vertical location surfaces 37 of the several reservoir blocks are essentially coplanar.

Reservoir blocks 31 also have flat parallel end surfaces 43. The flatness and parallelism of end surfaces 43 are not nearly as important and the length of blocks 31 is such that end surfaces 43 do not necessarily touch, since some clearance is desirable between the end surfaces 43 of adjacent reservoir blocks 31 to enable them to be easily assembled. In the preferred embodiment of the invention, the hammer blocks 15 of the several subassemblies 11 do not have end surfaces in contact. While three reservoir blocks are shown, the number may be more or less depending on the number of hammer subassemblies 11 which in turn depends on the number of print positions of the print lines being printed. In a particular embodiment of the invention, there are three reservoir blocks 31 each of which supplies lubricant to several hammer subassemblies 11. Thus each reservoir block 31 in combination with one or more hammer blocks 15 forms a lubrication subsystem with plural hammer blocks 15 and, in the print hammer unit 10, there are a plurality of lubrication subsystem each supplemented by the supply of lubricant in the respective reservoir block 31.

Hammer blocks 15 and reservoir blocks 31 may be made of sintered bronze alloy or other material having similar interconnected porous microstructure capable of holding and distributing oil such as IBM #6. The microstructure of the reservoir block 31 should be at least as coarse as, but preferably is coarser than the microstructure of the hammer blocks 15. The coarser microstructured has the advantage in that it has the ability to give up oil more readily to the finer microstructure of the hammer block 15. In a preferred embodiment in which the invention can be practiced, the reservoir block was made with PMB 18 powder which is a product of SCM Corporation. The hammer block was made with PMB 13 powder. The hammer block density was 6.8 to 7.0 grams per cubic centimeter and the reservoir block density was in the range of 6.3 to 6.7 grams per cubic centimeter. The resulting microstructure ensured a unidirectional flow of oil by capillary action across the interface formed by adjoining vertical locating surfaces 27 and 28 of hammer block 15 and 38 of reservoir block 31. The combination also results in the maintenance of a higher percentage of oil capacity in the hammer block 15 compared to the reservoir block 31. In addition, the rate of oil transfer from the reservoir block 31 to the hammer block 15 was sufficient to keep up with the oil depletion rate of the hammer block 15 at all operating conditions of a high speed printer throughout its operating life.

It has been found that one cause of oil depletion is due to paper dust absorption. This occurs for example on the top surface 44 of reservoir block 31 but could occur on any exposed surface including the bottom surface 47. The top surface 44 therefore as seen in FIG. 5 is provided with a protective shield 45. In addition to protecting the reservoir block from dust absorption, shielding could also be used to reduce oxidation of the block material and oil evaporation. Shielding 45 could take the formed film with adhesive bonding. The hot vacuum forming of a sheet epoxy may also be satisfactory with a curing cycle following its application. Another form of protective shielding could be a sealant applied to surface 44. A preferred sealant was Emralon 333 which is a product of Atchison Colloids Corp.

Figure 6:
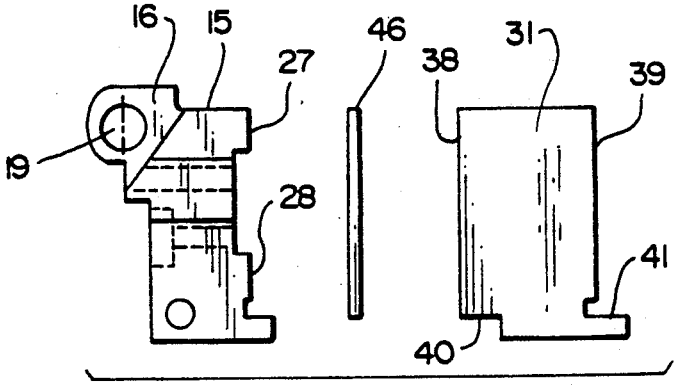
FIG. 6 is an exploded view of a modification of the hammer and reservoir blocks using a transfer medium.

One of the requirements for efficient transfer of lubricant from the reservoir block 31 to the hammer block is that the adjoining surfaces have good surface contact and have a minimally disturbed microstructure so that lubricant will transfer freely and at as high a rate as possible. In the event that poor contact occurs due to surfaces that are rough or not flat, it has been found that a compliant porous membrane 46 (see FIG. 6) such as paper significantly enhances the rate of oil transfer. Other usable materials might be cotton fabric or soft leather such as chamois.

This membrane 46 also provides connectivity between microducts of the opposed surfaces 27, 28 and 38 which might not be aligned for proper oil transfer. This membrane 46 has permeability and low impedance to oil flow thus allowing capillary oil flow convergence to points which would otherwise have low rates of oil transfer.

Thus it will be seen that a passive lubrication system has been provided for a print hammer mechanism which is effective, less costly and which is capable of supplying lubricant for a period of time at least equal to the useful life of the print hammer mechanism. Other advantages will readily occur to persons skilled in the art of printer mechanisms.

While the invention has been particularly shown and described with reference to specific embodiments thereof, it will be understood by those skilled in the art that the foregoing and other changes in form may be made therein without departing from the spirit and scope of the invention.

What is claimed is:

1. In a printer apparatus having a plurality of hammer elements in pivotal engagement with a pivot element, said hammer elements and said pivot element having means forming bearing interfaces, a passive lubrication system for supplying lubrication to said bearing interfaces comprising a hammer block member made of sintered material having a porous microstructure impregnated with a supply of lubricant and having means adapted for applying said lubricant by capillary flow to said bearing interfaces, and a reservoir block member made of sintered material with a porous microstructure impregnated with a supplementary supply of lubricant, said reservoir block member being connected to said hammer block member in a manner whereby lubricant from said supplementary supply flows by capillary action to said hammer block member.

2. In a printer apparatus, a passive lubrication system according to claim 1 where said hammer block member and said reservoir block member have adjoining microporous surfaces forming an interface for the transfer of lubricant by capillary action, and said microporous surface of said reservoir block member has a porosity which is of at least equal coarseness to the porosity of said microporous surface of said hammer block member.

3. In a printer apparatus, a passive lubrication system according to claim 1 where said microporous surface of said reservoir block member has a coarser porosity than the porosity of said microporous surface of said hammer block member so that the flow of said supplementary supply of lubricant is from said reservoir block member to said hammer block member across said interface.

4. In a printer apparatus, a passive lubrication system according to claim 3 where said sintered hammer and reservoir block members are formed of a blended bronze alloy.

5. In a printer apparatus, a passive lubrication system according to claim 4 where said adjoining surfaces of said hammer and reservoir block members are essentially flat surfaces formed by compression.

6. In a printer apparatus, a passive lubrication system according to claim 5 where said reservoir block member has at least one additional microporous surface exposed to contact by extraneous materials which cause ancillary capillary flow of said supplementary supply of lubricant, and sealant means is provided on said additional porous surface having means for preventing said ancillary capillary flow of said supplementary supply of lubricant caused by said extraneous materials.

7. In a printer apparatus having a plurality of print hammer elements in pivotal engagement with a pivot pin element, said hammer elements having means forming bearing interfaces with said pivot pin element and a lubrication system for supplying lubricant to said bearing interfaces including a hammer block of sintered material containing a supply of lubricant and having means for supplying lubricant to said bearing interfaces by capillary flow, and means for replenishing the supply of lubricant as depleted from said block means, the improvement in said lubrication system comprising a reservoir block of sintered material containing a supplementary supply of lubricant, said reservoir block and said hammer block having adjoining microporous surfaces forming an interface across which lubricant flows from said supplementary supply to said block means by capillary action.

8. In a printer apparatus according to claim 7 in which said hammer block and said reservoir blocks are made of a blended bronze alloy having a predetermined density.

9. In a printer apparatus according to claim 8 in which said density of said reservoir block is greater than the density of said hammer block.

10. In a printer apparatus according to claim 9 in which said reservoir block and its adjoining microporous surface has a coarser microstructure than said hammer block and its adjoining microporous surface so as to ensure capillary flow from said reservoir block to said hammer block.

11. A lubrication system for a printer apparatus having a hammer unit assembly comprising a plurality of print hammer subassemblies, said hammer subassemblies each having an elongated pivot pin means to form a support for a plurality of print hammer elements and hammer block means formed of sintered material containing a predetermined supply of lubricant, spacer means formed integrally with each of said hammer block means and formed of the same material as said hammer block means so as to receive a flow of said lubricant from said hammer block means, said spacer means having means defining an opening for receiving said elongated pivot pin means and being spaced apart for supporting individual ones of said hammer elements between adjacent spacers, and and means for replenishing lubricant as depleted from said hammer block means, the improvement comprising a single reservoir block member formed of sintered material containing a supplementary supply of lubricant, said plural hammer block means of said plurality of hammer subassemblies having microporous surfaces individually adjoining a common microporous surface of said reservoir block means to effect transfer of lubricant simultaneously from said supplementary supply to said hammer block means of said plurality of hammer subassemblies by capillary action.

12. In a printer apparatus according to claim 11 where said plural hammer block means and said reservoir means are formed of a blended bronze alloy having a predetermined density.

13. In a printer apparatus according to claim 12 where said reservoir block means and said common adjoining surface thereof has a porous microstructure which is at least as coarse as the porous microstructure of said plural hammer block means and their adjoining surfaces.

14. In a printer apparatus according to claim 13 where said reservoir block means and said common adjoining surface thereof has a coarser microstructure than said plural hammer block means and their said adjoining surfaces whereby simultaneous lubricant flow occurs readily from said reservoir block means to said hammer block means by capillary action.

15. A lubrication system for a printer apparatus having a hammer unit assembly comprising a plurality of print hammer subassemblies, said hammer subassemblies each having an elongated pivot pin means to form a support for a plurality of print hammer elements and hammer block means formed of sintered material and each containing a predetermined supply of lubricant, spacer means formed integrally with of the same material as said hammer block means so as to receive a flow of said lubricant from said hammer block means, said spacer means having means defining an opening for receiving said elongated pivot pin means and being spaced apart for supporting individual ones of said hammer elements between adjacent spacers, and means for replenishing lubricant as depleted from said hammer block means, the improvement comprising plural reservoir block means formed of sintered material and each containing a supplementary supply of lubricant, said plural reservoir block means each having a porous surface adjoining plural porous surfaces of a group of hammer block means to form plural interfaces for the simultaneous flow of lubricant from each of said plural reservoir block means to said group of hammer block means by capillary flow.

16. In a printer apparatus according to claim 15 where said hammer unit assembly further comprises an elongate frame, said plural reservoir block means comprise plural elongate reservoir blocks fixedly arranged end to end on said frame with said porous adjoining surfaces being substantially coplanar, and said plurality of hammer subassemblies are fixedly attached to said reservoir blocks with said adjoining porous surfaces of said hammer block means being substantially coplanar and forming said plural interfaces with said reservoir blocks.

17. In a printer apparatus according to claim 15 where said adjoining surfaces of said reservoir blocks and said hammer blocks are flat surfaces and said hammer subassemblies form a straight row of said hammer elements.

18. In a printer apparatus in accordance with claim 17 in which the improvement in said lubrication system further includes a porous transfer membrane between and in contact with said adjoining microporous surfaces of said reservoir and said hammer blocks.

19. In a printer apparatus in accordance with claim 17 in which said porous membrane is a sheet of fibrous material.

20. In a printer apparatus in accordance with 17 in which said porous membrane is a sheet of paper.

21. In a printer apparatus according to claim 1 in which said reservoir block member is arranged for supporting and locating said hammer block member.

* * * * *